US010559285B2

(12) United States Patent
Kwa et al.

(10) Patent No.: US 10,559,285 B2
(45) Date of Patent: Feb. 11, 2020

(54) ASYNCHRONOUS SINGLE FRAME UPDATE FOR SELF-REFRESHING PANELS

(71) Applicant: INTEL CORPORATION, Santa Clara, CA (US)

(72) Inventors: Seh Kwa, Saratoga, CA (US); Todd Witter, Orangevale, CA (US); Nausheen Ansari, Folsom, CA (US); Gaurav Sutaria, Folsom, CA (US)

(73) Assignee: INTEL CORPORATION, Santa Clara, CA (US)

( * ) Notice: Subject to any disclaimer, the term of this patent is extended or adjusted under 35 U.S.C. 154(b) by 0 days.

(21) Appl. No.: 15/942,462

(22) Filed: Mar. 31, 2018

(65) Prior Publication Data

US 2019/0051269 A1 Feb. 14, 2019

(51) Int. Cl.

| | |
|---|---|
| ***G09G 5/00*** | (2006.01) |
| ***G09G 5/36*** | (2006.01) |
| ***G09G 5/39*** | (2006.01) |
| ***G09G 5/393*** | (2006.01) |

(52) U.S. Cl.

CPC ..... *G09G 5/393* (2013.01); *G09G 5/006* (2013.01); *G09G 5/363* (2013.01); *G09G 2310/04* (2013.01); *G09G 2360/08* (2013.01); *G09G 2360/127* (2013.01)

(58) Field of Classification Search

CPC .... G09G 5/006; G09G 5/393; G09G 2310/04; G09G 2360/08; G09G 2360/127

USPC ..... 345/501, 545

See application file for complete search history.

(56) References Cited

U.S. PATENT DOCUMENTS

| | | | | |
|---|---|---|---|---|
| 2011/0157198 | A1* | 6/2011 | Vasquez | G09G 5/003 345/531 |
| 2012/0075188 | A1* | 3/2012 | Kwa | G09G 3/2096 345/168 |
| 2012/0147020 | A1 | 6/2012 | Hussain et al. | |
| 2013/0021352 | A1* | 1/2013 | Wyatt | G09G 5/395 345/520 |
| 2014/0002739 | A1 | 1/2014 | Kwa et al. | |
| 2014/0253537 | A1* | 9/2014 | Lee | G09G 5/12 345/214 |
| 2015/0264298 | A1 | 9/2015 | Colenbrander | |
| 2015/0379665 | A1* | 12/2015 | Kwa | G06T 1/20 345/522 |

OTHER PUBLICATIONS

Anonymous: "AUO Product Specification", Model name B125HAN02.2 (H/W:OA) Jul. 28, 2015, pp. 1-32 URL: https://www.touchandscreen.de/mediafiles/Datasheets/AUO/B125HAN02.2%20HW0A.pdf.

European Search Report and Written Opinion for the European Patent Application No. EP19160077, dated May 15, 2019, 11 pages.

* cited by examiner

*Primary Examiner* — Jacinta M Crawford

(57) ABSTRACT

Disclosed herein are techniques to provide both asynchronous frame updates and panel self-refresh in a single implementation. A platform can be arranged to provide frame updates asynchronously with the refresh rate of a connected panel while the connected panel can be arranged to self-refresh where no new updates are provided.

19 Claims, 10 Drawing Sheets

ASYNCHRONOUS SINGLE FRAME UPDATE FOR SELF-REFRESHING PANELS

TECHNICAL FIELD

Embodiments described herein generally relate to refreshing display panels and particularly to refreshing images displayed on panels with partial and full frame updates.

BACKGROUND

Display panels include memory that stores, for each pixel, the color to be displayed. Pixel memory retention times are on the order of tens to hundreds of milliseconds. However, an image may remain on the screen for viewing over an extended viewing period on the order of tens or hundreds of seconds, if not minutes. Thus, the pixel memory is periodically refreshed at what is known as a refresh rate.

Modern display panels typically include frame buffers, which are integrated into the display panel and provide memory retention to allow for the panel to "self-refresh." Self-refresh techniques provide a significant boost to energy efficiency of display devices.

DETAILED DESCRIPTION

Figure 1:
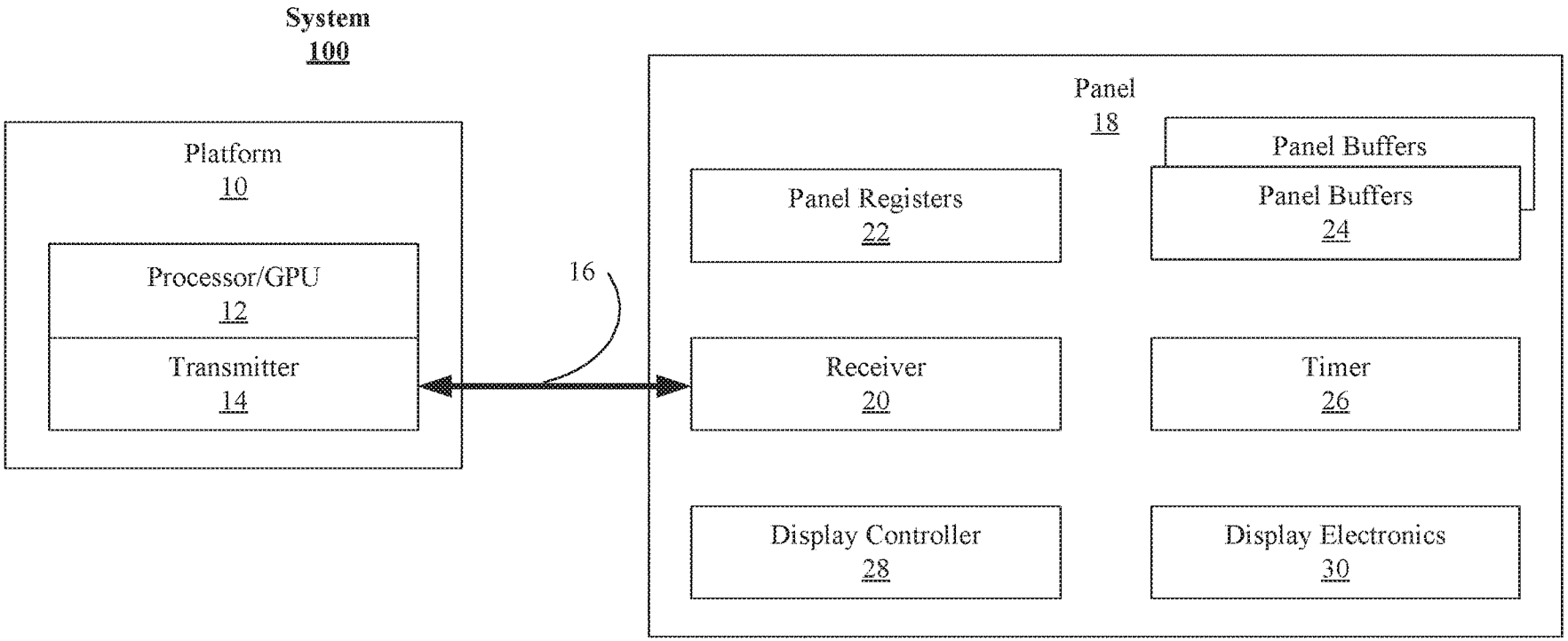
FIG. 1 illustrates an embodiment of a display system.

The present disclosure is generally directed to providing an asynchronous single frame update (ASFU) mechanism and to display systems and panels arranged to provide ASFU. In general, ASFU provides for adaptive synchronization in conjunction with and self-refreshing panels in a single implementation.

Display panels arranged to provide self-refresh (e.g., panel self-refresh (PSR), dynamic self-refresh (DSR), or the like) generally include local frame buffers and are arranged to display images from their local frame buffers for frame replays. Additionally, some modern display panels may include longer pixel retention times than conventional panels, thereby enabling for a longer period between necessary frame refreshes. This rate as which the display panel is "refreshed" is referred to as the refresh rate or frame refresh rate.

Adaptive synchronization dynamically changes the refresh rate. With some examples, adaptive sync can change the refresh rate on a frame by frame basis. In general, adaptive sync may change the refresh rate to match that of the render rate (e.g., the rate at which new frames are generated).

The present disclosure applies to self-refreshing panels, which can dynamically change their refresh rate on a frame by frame basis. In general, the present disclosure provides techniques and display systems where, for every frame that the source updates, the refresh rate will be varied to match the render rate. The display refresh rate can be varied by varying the vertical blanking (VB) interval. Where there are no updates (e.g., no new frame, no "flip" issued, or the like within the maximum VB interval (typically defined by the panel), the display link may be shut down and the panel can refresh the most recent frame from its local frame buffer. Once a frame update is made, the source can power up from the low power state, bring up the link (e.g., using a fast link training (FLT) technique), and send the updated frame to the sink. The sink can then switch to the updated frame.

Thus, the present disclosure provides advantages in that a display panel and mechanisms for display panels can be realized that may have performance benefits of adaptive synchronization (e.g., reduction in image jitter or tearing) and power efficiency benefits of self-refresh (e.g., reduction in consumed power due to power management of the link and/or display panel components during self-refresh).

Various embodiments may comprise one or more elements. An element may comprise any structure arranged to perform certain operations. Each element may be implemented as hardware, software, or any combination thereof, as desired for a given set of design parameters or performance constraints. Although an embodiment may be described with a limited number of elements in a certain topology by way of example, the embodiment may include more or less elements in alternate topologies as desired for a given implementation. It is worthy to note that any reference to "one embodiment" or "an embodiment" means that a feature, structure, or characteristic described relating to the embodiment is included in at least one embodiment. The appearances of the phrases "in one embodiment," "in some embodiments," and "in various embodiments" in various places in the specification are not necessarily all referring to the same embodiment.

FIG. 1 illustrates a display system 100, arranged according to at least one embodiment of the disclosure. As depicted, the display system 100 includes a platform 10 and a panel 18 coupled by a display interface 16. In general, the platform 10 can comprise any platform arranged to generate images to be displayed by the panel 18. For example, the platform 10 could be integrated into, part of, or comprise, a laptop computer, a desktop computer, an ultrabook, a cellular telephone, or any processor-based device. In general, panel 18 can be integrated into, part of, or comprise, any of a variety of displays, such as, light emitting diode (LED) displays, organic LED (OLED) displays, liquid crystal displays (LCD), or the like. Display interface 16 may be any of a variety of display interfaces, such as, for example, a display port interface, an embedded display port interface, a high-definition multimedia interface (HDMI), or the like.

The platform 10 may have a processing unit 12, which can be a conventional processor, a graphics processing unit (GPU) or a combination of conventional processor and GPU. Hereafter, however, the processor and/or GPU 12 is simply referred to as GPU 12. Platform 10 further includes a transmitter 14. Processor 12 and transmitter 14 may constitutes a display engine. Platform 10 may be provided as a System-on-Chip (SoC), such as may be integrated into a display system device (e.g., mobile phone, laptop, portable media device, etc.). In general, platform 10 sends images for display by panel 10 via display interface 16. For example, platform 10 can send, via transmitter 14 and display interface 16, information elements including indications of pixel data (e.g., color, locations, etc.) generated by GPU 12 to panel 18. Such information elements (or "frames") often sent at intervals corresponding to a frame rate of panel 18. This is described in greater detail below.

Panel 18 may include a receiver 20, panel registers 22, panel buffers 24, timer 26, display controller 28 and display electronics 30. In general, panel 18 can receive frames (e.g., from platform) at receiver 20 via display interface 16. Receiver 20 can provide the frames to display controller 28, which in turn, provides the frames for display on display electronics 28. Receiver 20 and/or display electronics may have access to panel registers 22, which may store indications of settings for panel 18 (e.g., refresh rate, etc.). Timer 24 can be coupled to receiver 20 and/or display controller 28 and can operate to provide an expiration of a frame refresh interval, or expiation of a period where the display interface 16 link is shut down to conserve power, for example, when the panel 18 is operating in a self-refresh mode, sometimes referred to as panel self-refresh (PSR).

Panel buffer 24 provides memory storage for frames received via display interface 16. Display controller 28 can operate to shut down portions of panel (e.g., receiver, or the like) during periods of PSR and can refresh display electronics from indications of the frame stored in panel buffers 24.

During operation, GPU 12 can generate frames (refer to FIGS. 2-4) for display by panel 18. In general, the frames can include indications of pixel data (e.g., pixel colors, etc.) which define an image to be display by display electronics of panel 18. For each frame generated by GPU 12, system 100 can dynamically change the refresh rate of panel 18 to match that of the "render rate" or the rate at which GPU 12 is generating frames. This dynamic change in the refresh rate can be made for each frame.

For example, transmitter 14 can vary the VB interval from frame to frame. Panel 18 may have a minimum and a maximum VB interval. As such, transmitter 14 can extend the VB interval, unto the maximum VB interval, where the GPU 12 has not generated a new frame. Upon expiration of the dynamically extended VB interval, the transmitter can power down the link and the panel 18 can refresh from a most recently received frame (e.g., stored in panel buffers 24, or the like). Additionally, panel 18 may implement other power management features, such as, power gating the receiver, or the like. Once GPU 12 renders a new frame, transmitter 14 can power up the link, retrain the link (e.g., using FLT, or the like) and send the updated frame to the panel (e.g., to receiver 20).

Figure 2:
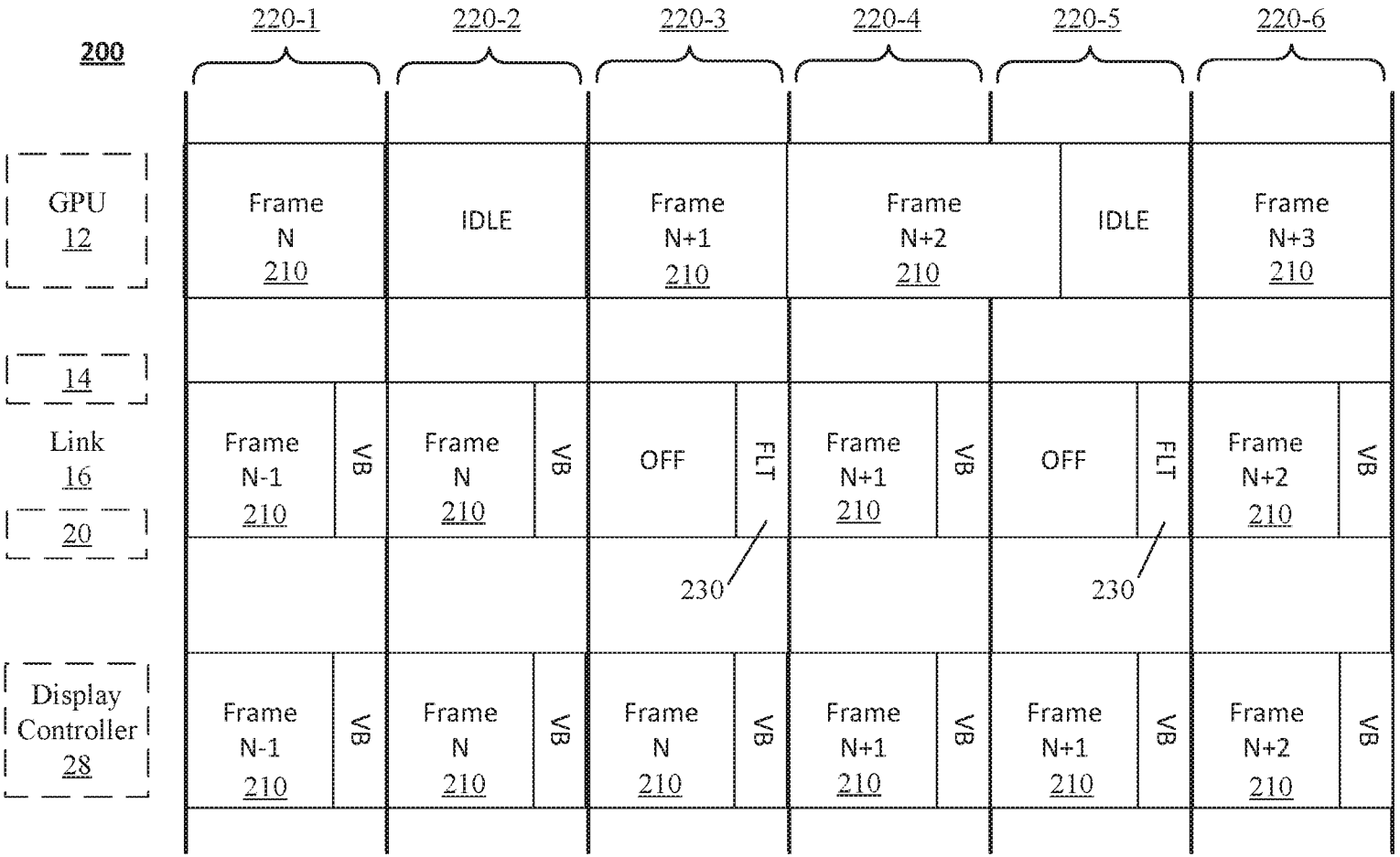
FIG. 2 illustrates a first example technique.
Figure 3:
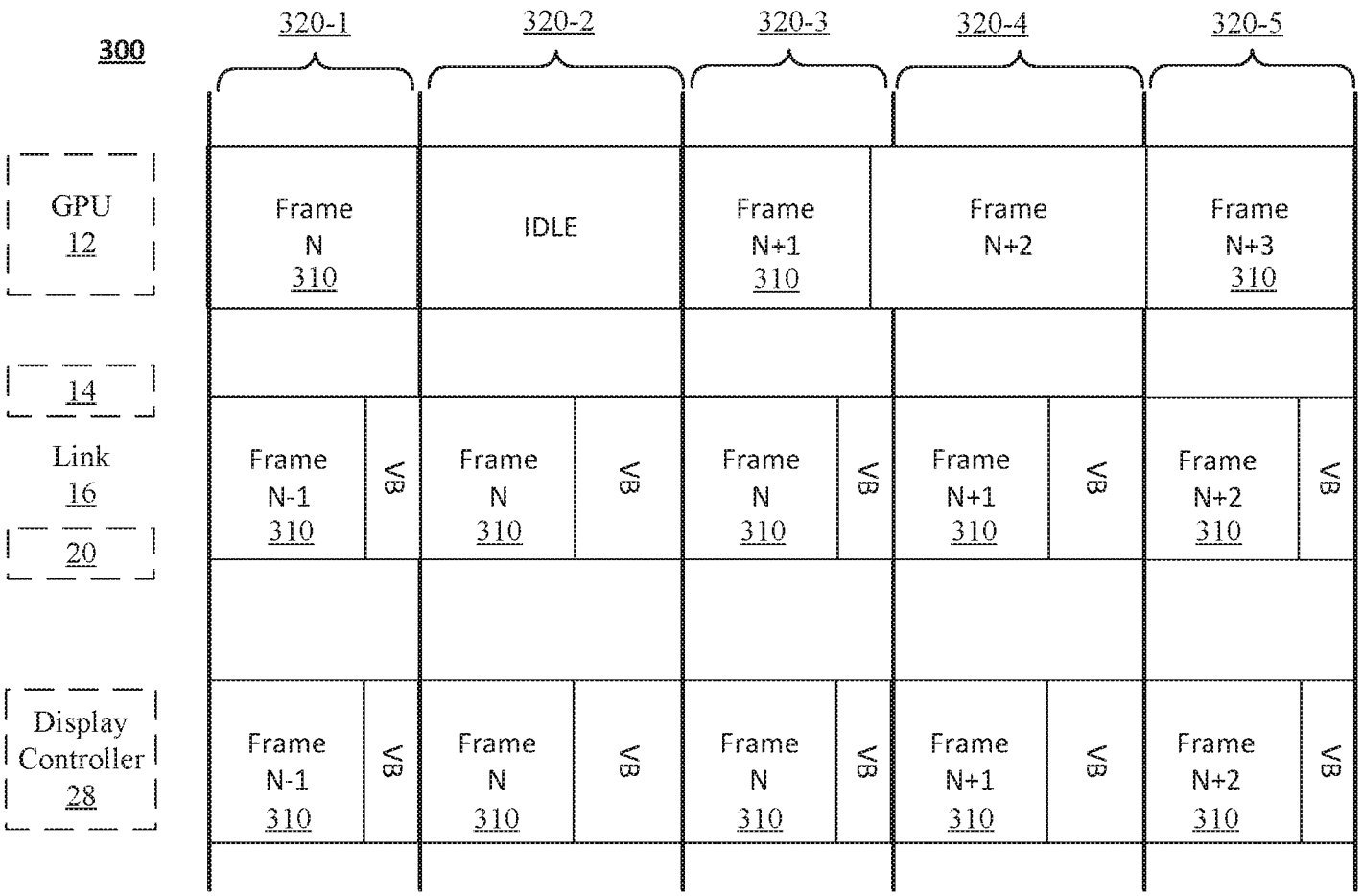
FIG. 3 illustrates a second example technique.
Figure 4:
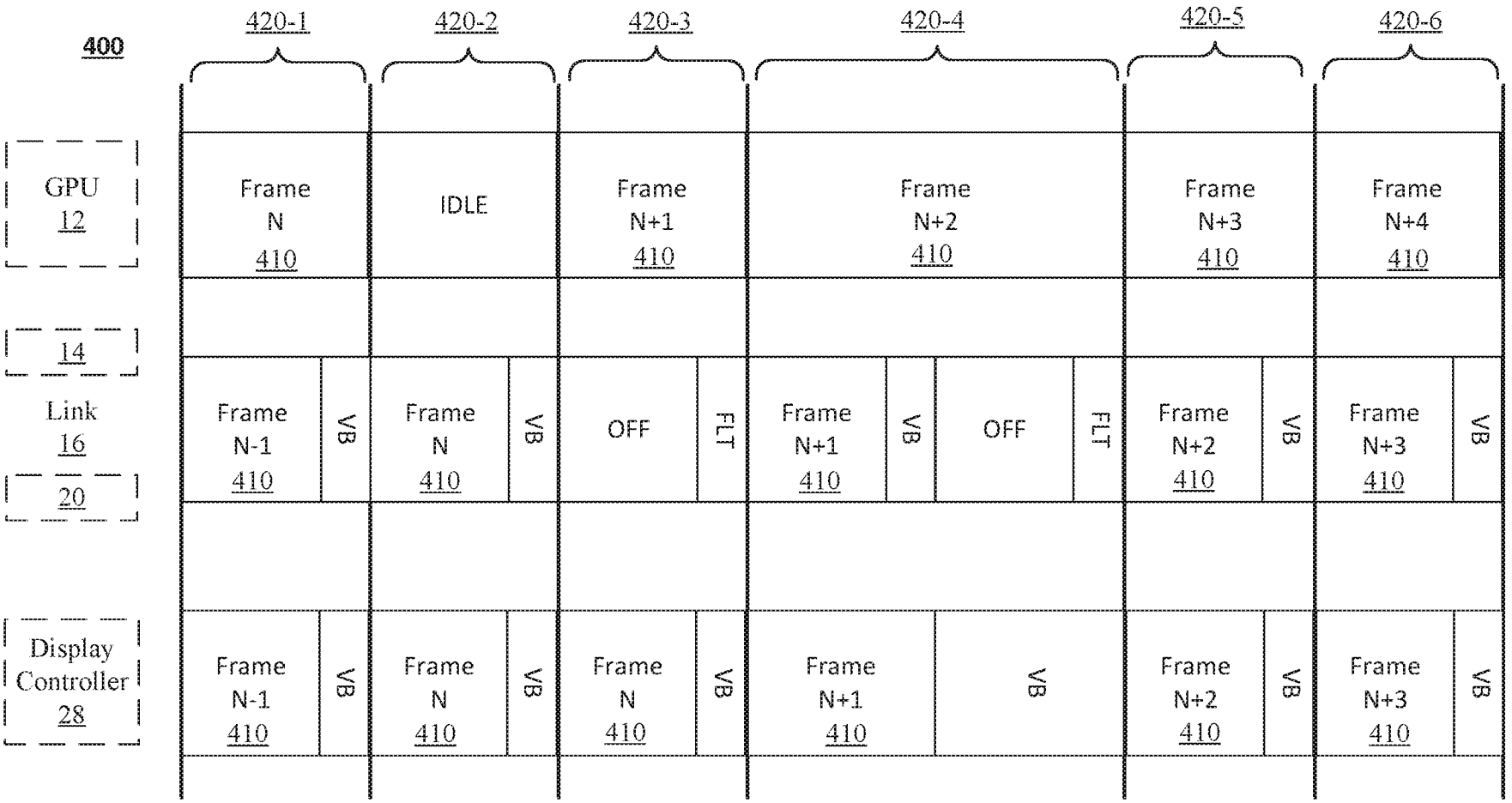
FIG. 4 illustrates a third example technique.

FIGS. 2-4 illustrate techniques 200 to 500, respectively. Specifically, FIG. 2 illustrates technique 200 for panel self-refresh, FIG. 3 illustrates technique 300 for adaptive synchronization, while FIG. 4 illustrates technique 400 for ASFU. It is noted, that the ASFU technique 400 depicted in FIG. 4 is a combination of both techniques 200 and 300. As such, it is beneficial to discuss techniques 200 and 300 individually first.

Turning now to FIG. 2 and technique 200. In technique 200, GPU 12 generates frames 210 during various VB intervals 220. It is noted, that frames 210 are designated as "Frame N(+x)" in the figures. Where "Frame N" corresponds to a first frame, "Frame N+1" corresponds to a next frame in a sequence, etc. It is noted, that GPU 12 could generate frames according to any of a variety of image generation techniques or methods. Transmitter 14 can encode the frames and transmit the frames, to receiver 20, via link 16 using any of a variety of encoding standards. Furthermore, as depicted, GPU 12 does not generate a new frame 210 during each VB interval 220. For example, VB intervals 220-1 to 220-6 are depicted. However, GPU 12 is only depicted generating frames 210 during VB interval 220-1, 220-3, 220-4, and 220-6. Furthermore, GPU 12 generates frame 210 (e.g., Frame N+2) during VB interval 220-4 and part of VB interval 220-5. More specifically, the time for GPU 12 to render frame n+2 is longer than a single VB interval. Thus, rendering of the frame extends from the beginning of VB interval 220-4 and into VB interval 220-5. During VB interval 220-2 and the remaining portion of VB interval 220-5, GPU 12 is idle. More specifically, GPU 12 is not rendering frames during these VB intervals or during all portions of these VB intervals.

During each VB interval 220, transmitter 14 can send to receiver 20, via display interconnect link 16, a frame 210. Alternatively, transmitter 14, receiver 20 and link 16 could be shut down. For example, during VB intervals 220-1 and 220-2, transmitter 14 sends to receiver 20, via link 16, frame n−1 and frame n, respectively. Subsequently, during VB interval 220-3, link 16 is in an OFF state, corresponding to the idle GPU 12 during the prior VB interval (e.g., VB interval 220-2). Likewise, during VB interval 220-5, link 16 is in an OFF state, corresponding to the idle GPU 12 during the prior VB interval (e.g., VB interval 220-4). After VB intervals where the link 16 is OFF, the system 100 can power up and train the link (e.g., using a FLT process, or the like). For example, VB intervals 220-4 and 220-6 are preceded by a FLT process 230. AT which point, transmitter 14 can send to receiver 20, via link 16, a frame 210. Display controller 28 can cause images corresponding to frames 210 to be displayed by panel 18 (e.g., via display electronics 30) during each VB interval 220. Where the link 16 is off (e.g., VB interval 220-3 and 220-5) the panel can display frames (e.g., refresh frames, or the like) from panel buffers 24.

Turning now to FIG. 3 and technique 300. In technique 300, the VB intervals are dynamically modified between a minimum and maximum interval period based on whether frames are rendered within the range between the min/max interval period. It is noted, display sources typically operate in either vertical synchronization (VSync) or asynchronous synchronization (ASync) mode. In VSync mode, the sink processes the flips at a fixed rate independent of the rendering speed. This can result in quantization of the images and can be manifest as visible stuttering or lag. In ASync mode, flips occur as soon as the frame buffer is ready, which can result in tearing or images. With adaptive synchronization, the VB interval and panel refresh rate are dynamically changed to match the rate at which the GPU is rendering frames. For example, this figure depicts GPU 12 rendering frames 310 during VB intervals 320. However, as depicted, VB intervals 320 are not each the same length (e.g. in time). For example, VB intervals 320-2 and 320-4 are longer than VB intervals 320-1, 320-3 and 320-5. As noted herein, the VB interval may have a minimum and a maximum period, for example, assume panel 18 could operate on a refresh rate of between 24 and 120 Hz. Thus, platform 10 could dynamically change the VB interval to anywhere between 8.3 milliseconds and 41.6 milliseconds (e.g., corresponding to the refresh rate of 24 to 120 Hz). In some examples, the platform 10 can dynamically change (e.g., increase, decrease, or the like) the VB interval (e.g., in a step wise manner, or the like) up to the maximum VB interval supported by the panel 18.

In general, platform 10 can dynamically alter the VB interval 320 based on when GPU 12 renders frames 310. For example, if GPU 12 renders a frame before the expiration of the maximum VB interval, platform 10 can dynamically adjust the corresponding VB interval to match that of the render rate of the frame 310. Conversely, if GPU 12 renders a frame 310 prior to the minimum VB interval period, platform 10 could dynamically alter the VB interval to match that of the minimum VB interval period. As another example, if GPU 12 does not render a frame within the maximum VB interval period, platform 10 can dynamically alter the VB interval 320 to the maximum VB interval period. This is indicated by the longer VB intervals and VB periods indicated in technique 300. In cases where GPU 12 does not render a frame 310 within the maximum VB interval period (e.g., VB interval 320-2, or the like) transmitter 14 can send to receiver 20, via link 16, the prior frame 310. However, it is noted that the link 16 is never turned off, unlike in technique 200, even where Turning now to FIG. 4 and technique 400. In technique 400, refresh rate of the panel 18 is dynamically updated to match the rate at which the GPU 12 is rendering frames 410. For example, for every frame 410 rendered by GPU 12, the refresh rate of panel 18 is updated to match the rate at which the frame is rendered, within a specified minimum and maximum allowable refresh rate (e.g., 24 Hz to 120 Hz, or the like). The system 100 can vary the refresh rate by varying the VB interval 420. For example, where GPU 12 does not render a frame 410 within the allowable VB interval (e.g., no flip is issued prior to expiration of the maximum VB interval as defined by panel 18), the system 100 may shut down link 16 (as well as transmitter 14 and/or receiver 20). During such VB intervals 420, panel 18 can refresh from local timing (e.g., timer 26 and panel buffers 24). During periods where GPU does update a frame 410, platform 10 can power up link 16, implement FLT to synchronize the panel 18 with the platform 10, and send the updated frame to the panel as detailed herein. The panel can then switch to refreshing from the newly received frame 410.

With some implementations, where the panel 18 is self-refreshing (e.g., replaying a previously received frame from local buffers, the panel 18 can operate on local timing (e.g., based on timer 26) and at the lowest refresh rate supported by the panel 18. This can enable the source (e.g., platform 10) to enter a lower power state while the sink (e.g., panel) refreshes at the lowest refresh rate. Said differently, the panel 18 may refresh at the maximum allowed VB interval 420 period.

When GPU 12 does update a frame 410 within the dynamically adjusted VB interval 420, transmitter 14 can send to receiver 20, via link 16, the newly updated frame asynchronously to the display panels refresh timings. Panel 18 may include panel buffers 24 of sufficient size to accept the newly transited frame without tearing the display. Said differently, panel 18 can accept the newly transmitted frame 410 into panel buffers 24 without needing to show portions of each frame in a single refresh (or draw) of panel electronics 30. With some implementations, this can be realized by platform 10 writing new frame 410 into a portion of panel buffer 24 while the panel 18 continues to refresh based on the prior frame from a separate portion of panel buffers 24. For example, FIG. 1 depicts multiple panel buffers 24. These multiple buffers can be utilized by the source to send new frame updates asynchronously to the refresh rate of panel 18. Panel 18 can switch to refreshing from the newly received frame 410 at the next available VB interval.

Figure 5:
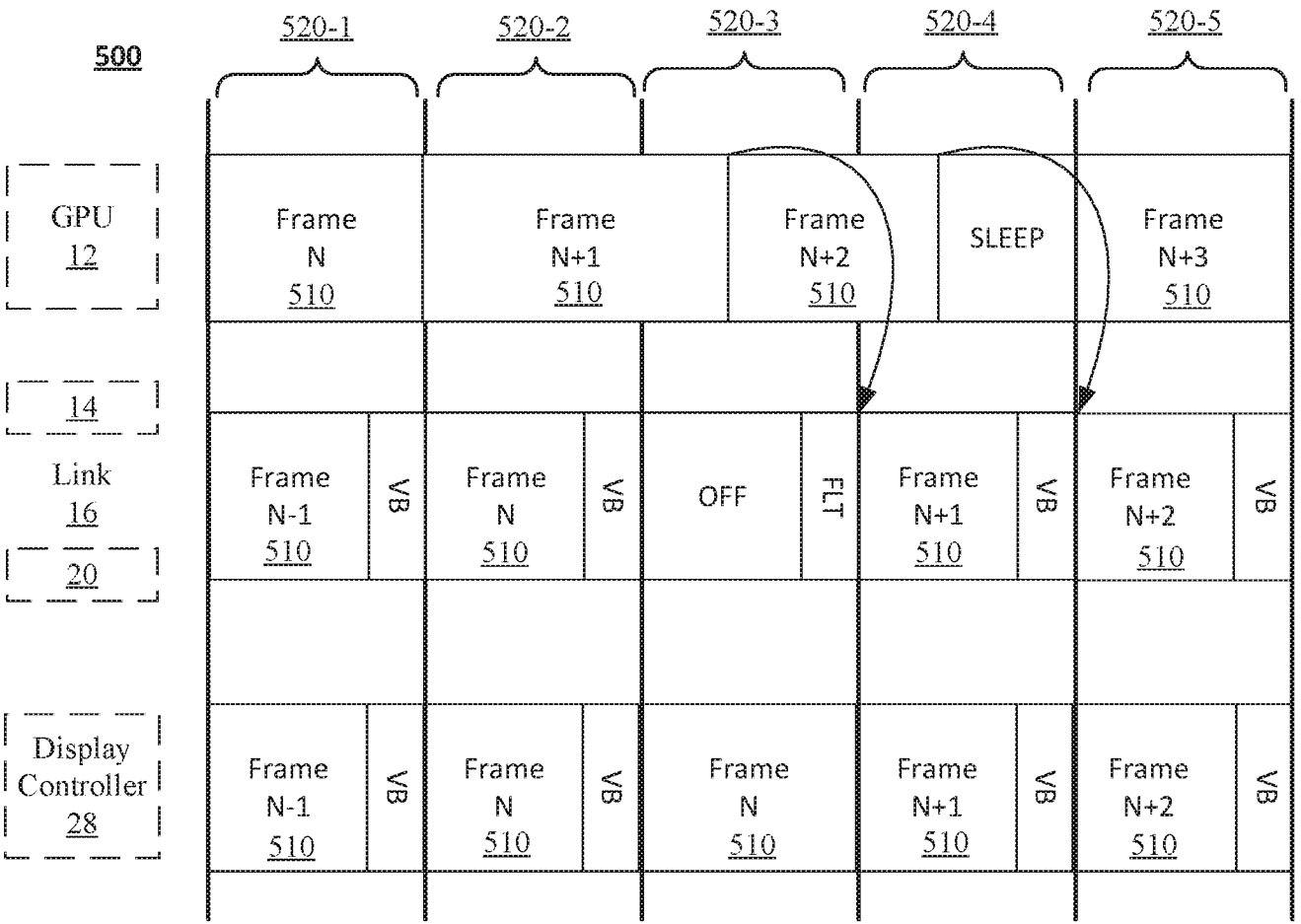
FIG. 5 illustrates a fourth example technique.

With some examples, the system 10 can schedule flips (e.g., frame updates). For example, platform 10 may be arranged to schedule a flip to be executed at a future time and transition the GPU 12 to lower power state(s) based on this scheduling. FIG. 5 depicts a frame update schedule 500 that may be implemented by system 100 to allow platform 10 to enter lower power states during periods where the GPU 12 might be idle.

As illustrated, the source (e.g., platform 10, or the like) can transmit frames at a scheduled time. For example, at the end of each VB interval 520 where a new frame is ready. Transmission can be asynchronous to the display timing and refresh rate as detailed above. For example, transmitter 14 can send to receiver 20, via link 16, frames 510 at each VB interval 520 where a new frame is ready. In instances where GPU 12 renders a frame 510 prior to the expiration of a VB interval 520 (e.g., VB intervals 520-3 and 520-4) platform 10 can schedule the transmission of the frames for the next VB interval. As such, GPU 12 and/or other platform components may be turned off or placed in a lower power state during portions of the VB interval where frames are not being rendered (e.g., portion of VB interval 520-4, or the like). Thus, technique 500 provides an advantage in employing the maximum VB interval for every frame enables additional opportunities power savings due to GPU 12 and/or link 16 gating.

Figure 6:
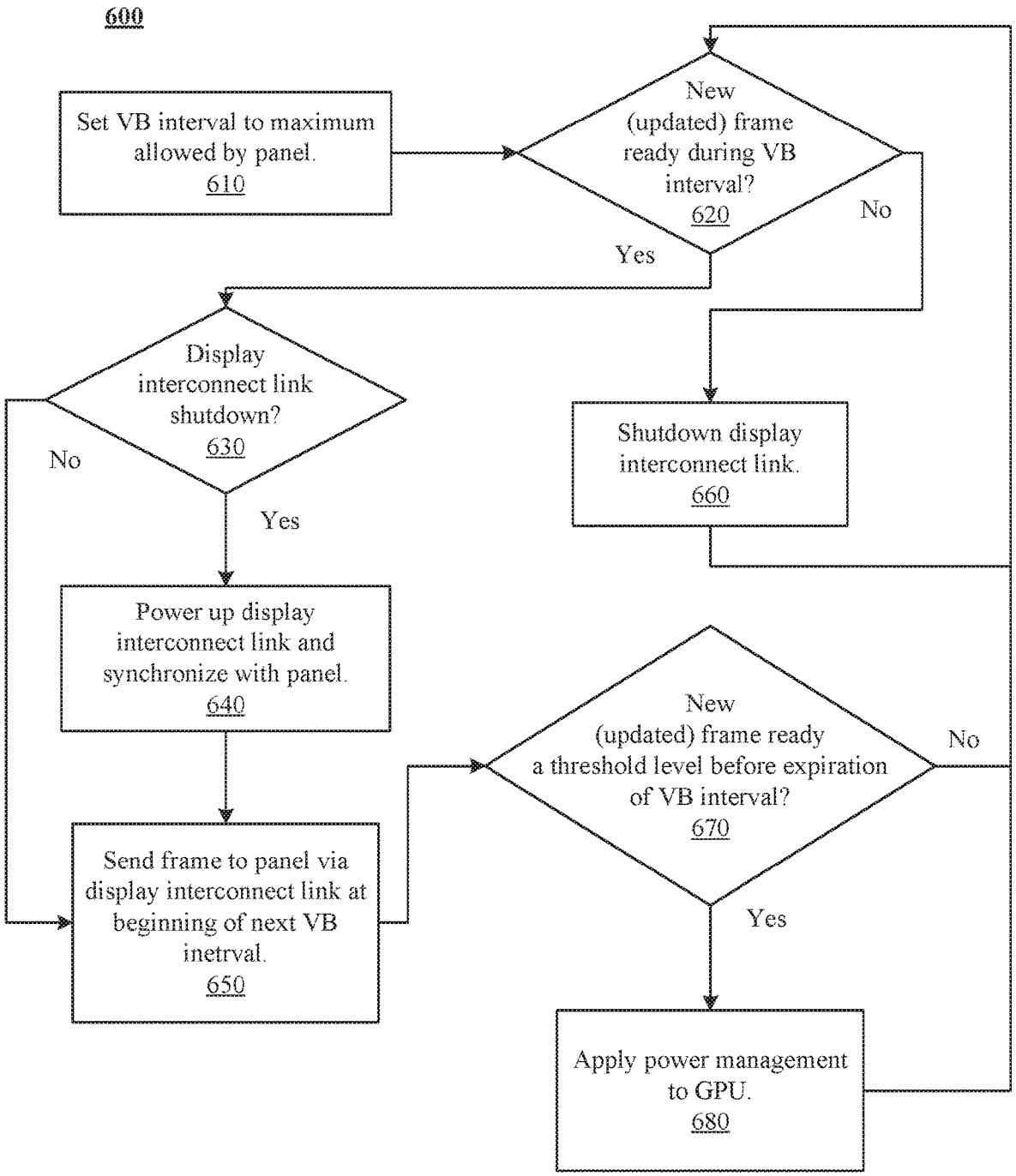
FIG. 6 illustrates a logic flow.

FIG. 6 illustrates a logic flow 600 for implementing asynchronous single frame update (ASFU). Logic flow 600 can be implemented by a platform coupled to a panel, such as, for example, platform 10 coupled to panel 18. Logic flow 600 can begin at block 610. At block 610 "set VB interval to maximum allowed by panel" the VB interval can be set to the maximum allowed by the panel. For example, platform 10 can set VB interval (e.g., VB interval 520, or the like) to the maximum VB interval allowed by the panel 18. Continuing to decision block 620 "new (updated frame ready during VB interval?" the source can determine whether a new (or updated) frame will be ready for transmission to the sink during the VB interval. For example, platform 10 can determine whether GPU 12 will complete rending a frame (or updates to a frame) during the VB interval 520. From decision block 620, logic flow 600 can continue to either decision block 630 or block 660. For example, logic flow 600 can continue from decision block 620 to decision block 630 based on a determination that a new (or updated) frame will be ready during the VB interval. Conversely, logic flow 600 can continue from decision block 620 to block 660 based on a determination that a new (or updated) frame will not be ready during the VB interval.

At block 660 "shutdown display interconnect link" the platform can shut down the display interconnect link. For example, platform 10 can shut down the link 16 based on a determination that no new (or newly updated) frames will be ready before the next VB interval.

At decision block 630 "display interconnect link shutdown?" the sink can determine whether the display link is shut down or not. For example, platform 10 can determine whether link 16 is shut down or not. From decision block 630, logic flow 600 can continue to either block 640 or block 650. For example, logic flow 600 can continue from decision block 630 to block 640 based on a determination that the link is shut down. Conversely, logic flow 600 can continue from decision block 630 to block 650 based on a determination that the link is not shut down.

At block 640 "power up display interconnect link and synchronize with panel" platform can power up the display interconnect link and synchronize with the panel. For example, platform 10 can power up link 16 and synchronize the link (e.g., using FLT, or the like) with panel 18. At block 650 "send frame to panel via interconnect link at beginning of next VB interval" the platform can send the new (or newly updated frame) to the panel via the link. For example, platform 10 can send frames 510 to the panel 18 via link 16 at the beginning of each VB interval after which the frame is ready.

From block 650, logic flow 600 can continue to decision block 670. At decision block 670 "new (updated) frame ready a threshold level before expiration of VB interval?" the sink can determine whether a new or updated frame will be ready a threshold level before expiration of the VB interval. For example, platform 10 can determine whether GPU 12 will complete rending a frame 510 before the VB interval ends, a threshold level before the VB interval ends. For example, platform 10 can determine that GPU 12 will complete rending frame 510 n+2 before VB interval 520-4 ends. From decision block 670, logic flow 600 can continue to either block 680 or return to decision block 620. For example, logic flow 600 can continue from decision block 670 to block 680 based on a determination that a new (or updated) frame will be ready a threshold level before expiration of the VB interval. Conversely, logic flow 600 can continue from decision block 670 to decision block 620 based on a determination that that a new (or updated) frame will not be ready a threshold level before expiration of the VB interval.

Figure 7:
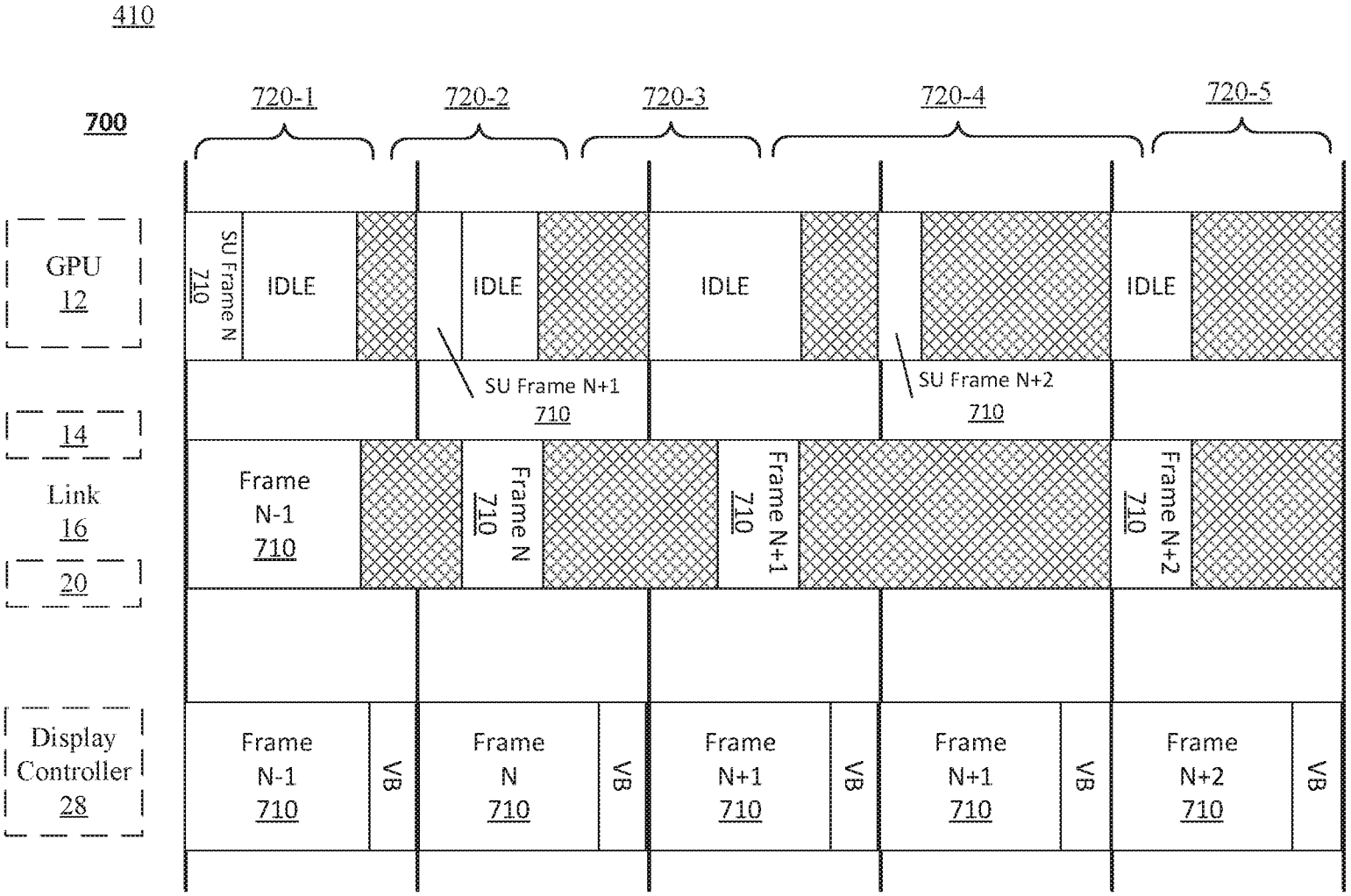
FIG. 7 illustrates a fifth example technique

With some examples, the system 10 can selectively update only a portion of the panel, or said differently, refreshing a portion of the display based on update data and refreshing the rest of the display from stored data. This is often referred to as asynchronous selective update. With conventional asynchronous selective update, due to the synchronous nature of the source and sink pixel clock, the updated frames (or frame portion) is expected to be sent when it needs to be displayed. FIG. 7 depicts a frame update schedule 700 that may be implemented by system 100 to implement asynchronous selective update.

As illustrated, the source (e.g., platform 10, or the like) can transmit frames at a scheduled time. For example, at the end of each VB interval 720 where a new frame is ready. Transmission can be asynchronous to the display timing and refresh rate as detailed above. For example, transmitter 14 can send to receiver 20, via link 16, frames (or partial frames, e.g., Frame N+1, Frame N+2, or the like) 710 at each VB interval 720 where a new frame is ready. In instances where GPU 12 renders a frame 710 prior to the expiration of a VB interval 720. However, as depicted, provided that data (e.g., frames 710) are being sent from the GPU 12 and/or transmitter 14 to receiver 20 via link 16, the GPU 12 and transmitter 14 must remain powered up. It is to be appreciated that this causes a significant drag on efficiency and power utilization.

Figure 8:
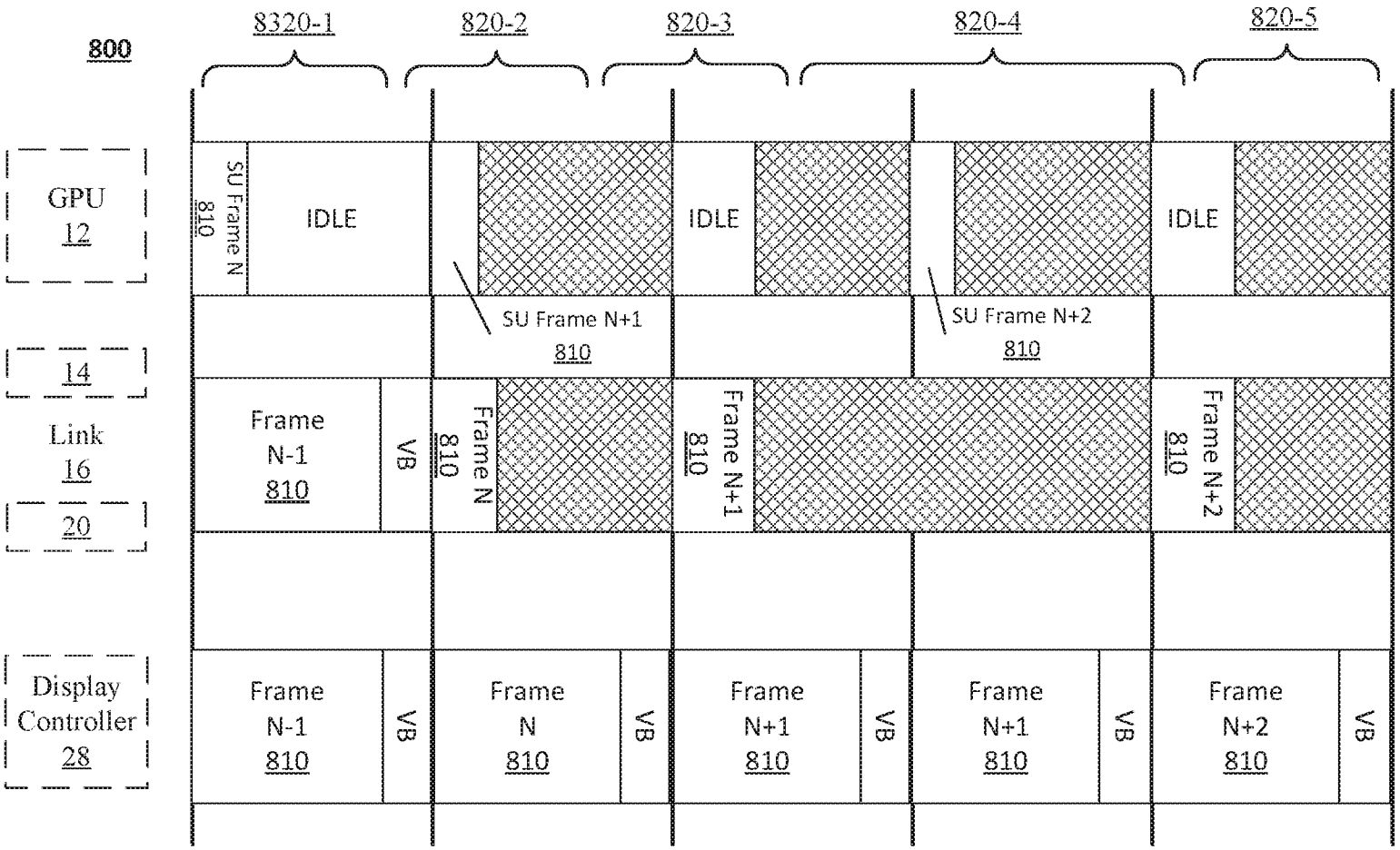
FIG. 8 illustrates a sixth example technique.

FIG. 8 depicts a frame update schedule 800 that may be implemented to send the updated frame (or partial frame) as a burst at the start of the refresh. As such, an increase in the time at which the GPU 12 and transmitter 14 can be powered down may be realized. As depicted in this figure, at each VB interval 8720 where a new frame is ready, GPU send frames 810 are send as a burst to receiver 20 via link 16. In some examples, secondary data can be sent to the receiver 20 to indicate to display controller 28 co-ordinates of the updated regions. With some examples, display panel can be refreshed with updated frames 810 (or partial frames) as the data is received. In some examples, updated frames 810 (or partial frames) can be stored to buffers in the panel (e.g., panel buffers 24, or the like) and then the panel can be refreshed as dictated by the refresh rate. The schedule 800 provides a distinct advantage in that the GPU 12, transmitter 14 and link 16 can be placed into a sleep state for longer periods, and possibly placed into a deeper sleep state than conventional asynchronous update schedules allow.

Figure 9:
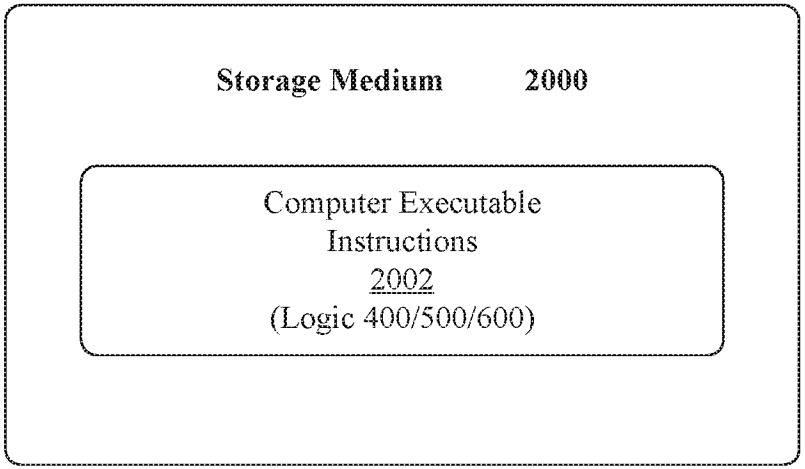
FIG. 9 illustrates one embodiment of a storage medium.

FIG. 9 illustrates an embodiment of a storage medium 2000. The storage medium 2000 may comprise an article of manufacture. In some examples, the storage medium 2000 may include any non-transitory computer readable medium or machine readable medium, such as an optical, magnetic or semiconductor storage. The storage medium 2000 may store various types of computer executable instructions e.g., 2002). For example, the storage medium 2000 may store various types of computer executable instructions to implement technique 400. For example, the storage medium 2000 may store various types of computer executable instructions to implement technique 500. In some examples, the storage medium 2000 may store various types of computer executable instructions to implement logic flow 600.

Examples of a computer readable or machine-readable storage medium may include any tangible media capable of storing electronic data, including volatile memory or non-volatile memory, removable or non-removable memory, erasable or non-erasable memory, writeable or re-writeable memory, and so forth. Examples of computer executable instructions may include any suitable type of code, such as source code, compiled code, interpreted code, executable code, static code, dynamic code, object-oriented code, visual code, and the like. The examples are not limited in this context.

Figure 10:
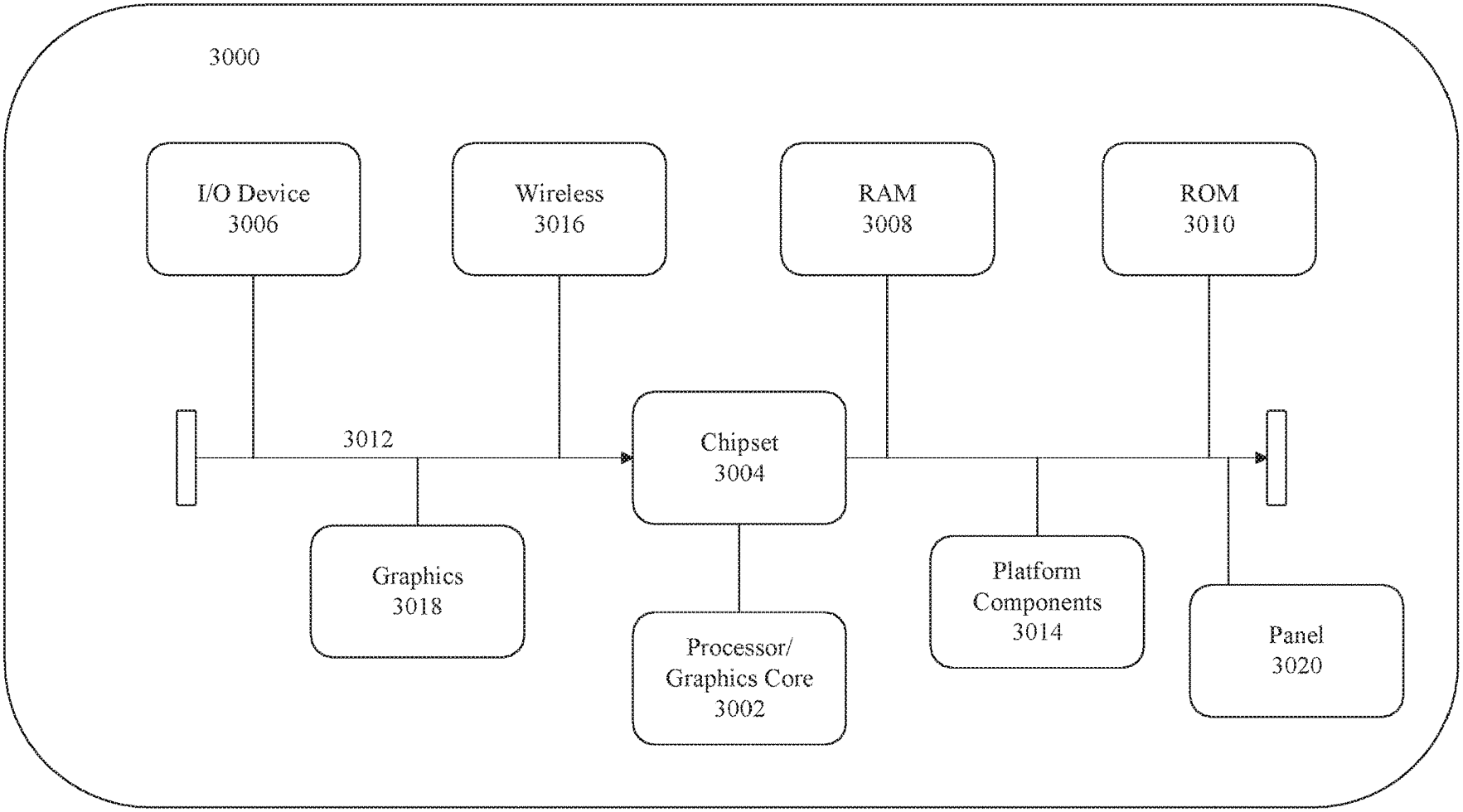
FIG. 10 illustrates one embodiment of a device.

FIG. 10 is a diagram of an exemplary system embodiment and, depicts a platform 3000, which may include various elements. For instance, this figure depicts that platform (system) 3000 may include a processor/graphics core 3002, a chipset 3004, an input/output (I/O) device 3006, a random-access memory (RAM) (such as dynamic RAM (DRAM)) 3008, and a read only memory (ROM) 3010, panel 3020 (e.g., panel 18, or the like) and various other platform components 3014 (e.g., a fan, a cross flow blower, a heat sink, DTM system, cooling system, housing, vents, and so forth). System 3000 may also include wireless communications chip 3016 and graphics device 3018. The embodiments, however, are not limited to these elements.

As depicted, I/O device 3006, RAM 3008, and ROM 3010 are coupled to processor 3002 by way of chipset 3004. Chipset 3004 may be coupled to processor 3002 by a bus 3012. Accordingly, bus 3012 may include multiple lines.

Processor 3002 may be a central processing unit comprising one or more processor cores and may include any number of processors having any number of processor cores. The processor 3002 may include any type of processing unit, such as, for example, CPU, multi-processing unit, a reduced instruction set computer (RISC), a processor that has a pipeline, a complex instruction set computer (CISC), digital signal processor (DSP), and so forth. In some embodiments, processor 3002 may be multiple separate processors located on separate integrated circuit chips. In some embodiments processor 3002 may be a processor having integrated graphics, while in other embodiments processor 3002 may be a graphics core or cores.

Some embodiments may be described using the expression "one embodiment" or "an embodiment" along with their derivatives. These terms mean that a feature, structure, or characteristic described relating to the embodiment is included in at least one embodiment. The appearances of the phrase "in one embodiment" in various places in the specification are not necessarily all referring to the same embodiment. Further, some embodiments may be described using the expression "coupled" and "connected" along with their derivatives. These terms are not necessarily intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, yet still co-operate or interact with each other. Furthermore, aspects or elements from different embodiments may be combined.

It is emphasized that the Abstract of the Disclosure is provided to allow a reader to quickly ascertain the nature of the technical disclosure. It is submitted with the understanding that it will not be used to interpret or limit the scope or meaning of the claims. In addition, in the foregoing Detailed Description, various features are grouped together in a single embodiment for streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment. In the appended claims, the terms "including" and "in which" are used as the Plain-English equivalents of the respective terms "comprising" and "wherein," respectively. Moreover, the terms "first," "second," "third," and so forth, are used merely as labels, and are not intended to impose numerical requirements on their objects.

What has been described above includes examples of the disclosed architecture. It is, of course, not possible to describe every conceivable combination of components and/or methodologies, but one of ordinary skill in the art may recognize that many further combinations and permutations are possible. Accordingly, the novel architecture is intended to embrace all such alterations, modifications and variations that fall within the spirit and scope of the appended claims. The detailed disclosure now turns to providing examples that pertain to further embodiments. The examples provided below are not intended to be limiting.

EXAMPLE 1

An apparatus, comprising: a transmitter to send a frame to a panel via a display interconnect; and a processor coupled to the transmitter, the processor to: schedule the transmitter sending the frame to the panel, via the display interconnect, at the beginning of a vertical blanking (VB) interval asynchronously from the panels frame refresh; and power down the display interconnect during a VB interval a frame is not scheduled to be sent to the panel.

EXAMPLE 2

The apparatus of example 1, the processor to: determine whether a full or a partial frame update is to be rendered within the current VB interval; and schedule sending the full or partial frame update to the panel during the next VB interval based on a determination that the full or partial frame update is to be rendered within the current VB interval.

EXAMPLE 3

The apparatus of example 2, the processor to: determine whether a graphics processing unit (GPU) will complete rendering the full or partial frame update a selected time before the current VB interval ends; and cause the GPU to enter a lower power state upon completion of rendering the full or partial frame update based on a determination that the GPU will complete rendering the full or partial frame update a selected time before the current VB interval ends.

EXAMPLE 4

The apparatus of example 2, the processor to shut down the display interconnect based on a determination that the full or partial frame update is not to be rendered within the current VB interval.

EXAMPLE 5

The apparatus of example 2, the processor to: determine whether the display interconnect is shut down; and power up the display interconnect and synchronize the transmitter with the panel based on a determination that the display interconnect is shut down.

EXAMPLE 6

The apparatus of example 1, the processor to increase the VB interval a threshold amount up to a maximum VB interval allowed by the panel.

EXAMPLE 7

The apparatus of example 1, the transmitter to send the frame to the panel in accordance with the Embedded Display Port (eDP) Standard v 1.4, published in February 2015 and promulgated by the Video Electronics Standards Association (VESA).

EXAMPLE 8

The apparatus of example 1, comprising a display interface coupled to the transmitter, the display interface to couple to the display interconnect.

EXAMPLE 9

The apparatus of example 8, the display interface comprising a display port interface or an embedded display port interface.

EXAMPLE 10

A method comprising: scheduling sending a frame, from a transmitter to a panel, via a display interconnect coupling the transmitter and the panel, scheduling sending the frame at the beginning of a vertical blanking (VB) interval asynchronously from the panels frame refresh; and powering down the display interconnect during a VB interval when a frame is not scheduled to be sent to the panel.

EXAMPLE 11

The method of example 10, comprising: determining whether a full or a partial frame update is to be rendered within the current VB interval; and scheduling sending the full or partial frame update to the panel during the next VB interval based on a determination that the full or partial frame update is to be rendered within the current VB interval.

EXAMPLE 12

The method of example 11, comprising: determining whether a graphics processing unit (GPU) will complete rendering the full or partial frame update a selected time before the current VB interval ends; and causing the GPU to enter a lower power state upon completion of rendering the full or partial frame update based on a determination that the GPU will complete rendering the full or partial frame update a selected time before the current VB interval ends.

EXAMPLE 13

The method of example 11, comprising shutting down the display interconnect based on a determination that the full or partial frame update is not to be rendered within the current VB interval.

EXAMPLE 14

The method of example 11, comprising: determining whether the display interconnect is shut down; and powering up the display interconnect and synchronizing the transmitter with the panel based on a determination that the display interconnect is shut down.

EXAMPLE 15

The method of example 10, comprising increasing the VB interval a threshold amount up to a maximum VB interval allowed by the panel.

EXAMPLE 16

The method of example 10, comprising sending the frame to the panel in accordance with the Embedded Display Port (eDP) Standard v 1.4, published in February 2015 and promulgated by the Video Electronics Standards Association (VESA).

EXAMPLE 17

The method of example 10, the display interface comprising a display port interface or an embedded display port interface.

EXAMPLE 18

At least one machine-readable storage medium comprising instructions that when executed by a processor at a platform coupled to a panel via a display interconnect, cause the processor to: schedule sending a frame, from a transmitter at the platform to the panel via the display interconnect, at the beginning of a vertical blanking (VB) interval asynchronously from the panels frame refresh; and power down the display interconnect during a VB interval when a frame is not scheduled to be sent to the panel.

EXAMPLE 19

The at least one machine-readable storage medium of example 18, comprising instructions that further cause the processor to: determine whether a full or a partial frame update is to be rendered within the current VB interval; and schedule sending the full or partial frame update to the panel during the next VB interval based on a determination that the full or partial frame update is to be rendered within the current VB interval.

EXAMPLE 20

The at least one machine-readable storage medium of example 19, comprising instructions that further cause the processor to: determine whether a graphics processing unit (GPU) at the platform will complete rendering the full or partial frame update a selected time before the current VB interval ends; and cause the GPU to enter a lower power state upon completion of rendering the full or partial frame update based on a determination that the GPU will complete rendering the full or partial frame update a selected time before the current VB interval ends.

EXAMPLE 21

The at least one machine-readable storage medium of example 18, comprising instructions that further cause the processor to shut down the display interconnect based on a determination that the full or partial frame update is not to be rendered within the current VB interval.

EXAMPLE 22

The at least one machine-readable storage medium of example 18, comprising instructions that further cause the processor to: determine whether the display interconnect is shut down; and power up the display interconnect and synchronizing the transmitter with the panel based on a determination that the display interconnect is shut down.

EXAMPLE 23

The at least one machine-readable storage medium of example 18, comprising instructions that further cause the processor to increase the VB interval a threshold amount up to a maximum VB interval allowed by the panel.

EXAMPLE 24

The at least one machine-readable storage medium of example 18, comprising instructions that further cause the transmitter to send the frame in accordance with the Embedded Display Port (eDP) Standard v 1.4, published in February 2015 and promulgated by the Video Electronics Standards Association (VESA).

EXAMPLE 25

The at least one machine-readable storage medium of example 18, the display interconnect comprising a display port interconnect or an embedded display port interconnect.

EXAMPLE 26

A system, comprising: a panel comprising at least a receiver; and a platform coupled to the panel via a display interconnect, the platform comprising: a transmitter to send a frame to a panel via a display interconnect; and a processor coupled to the transmitter, the processor to: schedule the transmitter sending the frame to the panel, via the display interconnect, at the beginning of a vertical blanking (VB) interval asynchronously from the panels frame refresh; and power down the display interconnect during a VB interval a frame is not scheduled to be sent to the panel.

EXAMPLE 27

The system of example 26, the processor to: determine whether a full or a partial frame update is to be rendered within the current VB interval; and schedule sending the full or partial frame update to the panel during the next VB interval based on a determination that the full or partial frame update is to be rendered within the current VB interval.

EXAMPLE 28

The system of example 27, the processor to: determine whether a graphics processing unit (GPU) will complete rendering the full or partial frame update a selected time before the current VB interval ends; and cause the GPU to enter a lower power state upon completion of rendering the full or partial frame update based on a determination that the GPU will complete rendering the full or partial frame update a selected time before the current VB interval ends.

EXAMPLE 29

The system of example 27, the processor to shut down the display interconnect based on a determination that the full or partial frame update is not to be rendered within the current VB interval.

EXAMPLE 30

The system of example 27, the processor to: determine whether the display interconnect is shut down; and power up the display interconnect and synchronize the transmitter with the panel based on a determination that the display interconnect is shut down.

EXAMPLE 31

The system of example 26, the processor to increase the VB interval a threshold amount up to a maximum VB interval allowed by the panel.

EXAMPLE 32

The system of example 26, the transmitter to send the frame to the panel in accordance with the Embedded Display Port (eDP) Standard v 1.4, published in February 2015 and promulgated by the Video Electronics Standards Association (VESA).

EXAMPLE 33

The system of example 26, comprising a display interface coupled to the transmitter, the display interface to couple to the display interconnect.

EXAMPLE 34

The system of example 33, the display interface comprising a display port interface or an embedded display port interface.

EXAMPLE 35

An apparatus comprising: scheduling means to send a frame, from a transmitter to a panel, via a display interconnect coupling the transmitter and the panel, scheduling sending the frame at the beginning of a vertical blanking (VB) interval asynchronously from the panels frame refresh; and powering down means to power down the display interconnect during a VB interval when a frame is not scheduled to be sent to the panel.

EXAMPLE 36

The apparatus of example 35, the scheduling means further comprising means to: determine whether a full or a partial frame update is to be rendered within the current VB interval; and schedule sending the full or partial frame update to the panel during the next VB interval based on a determination that the full or partial frame update is to be rendered within the current VB interval.

EXAMPLE 37

The apparatus of example 36, the scheduling means further comprising means to determine whether a graphics processing unit (GPU) will complete rendering the full or partial frame update a selected time before the current VB interval ends, and the powering down means further comprising means to cause the GPU to enter a lower power state upon completion of rendering the full or partial frame update based on a determination that the GPU will complete rendering the full or partial frame update a selected time before the current VB interval ends.

EXAMPLE 38

The apparatus of example 36, the powering down means further comprising means to shut down the display interconnect based on a determination that the full or partial frame update is not to be rendered within the current VB interval.

EXAMPLE 39

The apparatus of example 36, the scheduling means further comprising means to determine whether the display interconnect is shut down, the apparatus comprising powering up means to power up the display interconnect and synchronizing the transmitter with the panel based on a determination that the display interconnect is shut down.

EXAMPLE 40

The apparatus of example 35, the scheduling means further comprising means to increase the VB interval a threshold amount up to a maximum VB interval allowed by the panel.

EXAMPLE 41

The apparatus of example 35, comprising transmitter means to send the frame to the panel in accordance with the Embedded Display Port (eDP) Standard v 1.4, published in February 2015 and promulgated by the Video Electronics Standards Association (VESA).

EXAMPLE 42

The apparatus of example 35, the display interface comprising a display port interface or an embedded display port interface.

The invention claimed is:

1. An apparatus, comprising:

a transmitter to send a frame to a panel via a display interconnect; and a processor coupled to the transmitter, the processor to:

schedule the transmission of the frame to the panel at the beginning of a first one of a plurality of vertical blanking (VB) intervals asynchronously from a frame rate of the panel, the frame to be transmitted to the panel via the transmitter and the display interconnect;

dynamically modify a second one of the plurality of VB intervals between a minimum VB interval and a maximum VB interval;

determine whether a graphics processing unit (GPU) will complete rendering a full or partial frame update a selected time before the second one of the plurality of VB intervals ends;

schedule sending the full or partial frame update to the panel during a third one, following the second one, of the plurality of VB intervals based on a determination that the GPU will complete rendering the full or partial frame update the selected time before the second one of the plurality of VB intervals ends;

identify a fourth one of the plurality of VB intervals where a frame is not scheduled to be transmitted to the panel; and power down the display interconnect during the fourth one of the plurality of VB intervals.

2. The apparatus of claim 1, the processor to:

cause the GPU to enter a lower power state upon completion of rendering the full or partial frame update based on a determination that the GPU will complete rendering the full or partial frame update the selected time before the second one of the plurality of VB intervals ends.

3. The apparatus of claim 1, the processor to:

determine whether the display interconnect is shut down; and power up the display interconnect and synchronize the transmitter with the panel based on a determination that the display interconnect is shut down.

4. The apparatus of claim 1, the processor to increase the VB interval a threshold amount up to the maximum VB interval allowed by the panel to dynamically modify the second one of the plurality of VB intervals between the minimum VB interval and the maximum VB interval.

5. The apparatus of claim 1, the transmitter to send the frame to the panel in accordance with the Embedded Display Port (eDP) Standard v 1.4 ,published in February 2015 and promulgated by the Video Electronics Standards Association (VESA).

6. The apparatus of claim 1, comprising a display interface coupled to the transmitter, the display interface to couple to the display interconnect.

7. The apparatus of claim 6, the display interface comprising a display port interface or an embedded display port interface.

8. A method comprising:

scheduling the transmission of a frame to a panel at the beginning of a first one of a plurality of vertical blanking (VB) intervals asynchronously from a frame rate of the panel, the frame to be transmitted to the panel via a transmitter and a display interconnect coupled to the panel;

dynamically modifying a second one of the plurality of VB intervals between a minimum VB interval and a maximum VB interval;

determining whether a graphics processing unit (GPU) will complete rendering a full or partial frame update a selected time before the second one of the plurality of VB intervals ends;

scheduling sending the full or partial frame update to the panel during a third one, following the second one, of the plurality of VB intervals based on a determination that the GPU will complete rendering the full or partial frame update the selected time before the second one of the plurality of VB intervals ends;

identifying a fourth one of the plurality of VB intervals where a frame is not scheduled to be transmitted to the panel; and powering down the display interconnect during the fourth one of the plurality of VB intervals.

9. The method of claim 8, comprising:

causing the GPU to enter a lower power state upon completion of rendering the full or partial frame update based on a determination that the GPU will complete rendering the full or partial frame update the selected time before the second one of the plurality of VB intervals ends.

10. The method of claim 9, comprising:

determining whether the display interconnect is shut down; and powering up the display interconnect and synchronizing the transmitter with the panel based on a determination that the display interconnect is shut down.

11. The method of claim 8, comprising increasing the VB interval a threshold amount up to the maximum VB interval allowed by the panel to dynamically modify the second one of the plurality of VB intervals between the minimum VB interval and the maximum VB interval.

12. The method of claim 8, comprising sending the frame to the panel in accordance with the Embedded Display Port (eDP) Standard v 1.4, published in February 2015 and promulgated by the Video Electronics Standards Association (VESA).

13. The method of claim 8, the display interconnect comprising a display port interconnect or an embedded display port interconnect.

14. At least one non-transitory machine-readable storage medium comprising instructions that when executed by a processor at a platform coupled to a panel via a display interconnect, cause the processor to:

schedule the transmission of a frame to the panel at the beginning of a first one of a plurality of vertical blanking (VB) intervals asynchronously from a frame rate of the panel, the frame to be transmitted to the panel via a transmitter and the display interconnect;

dynamically modifying a second one of the plurality of VB intervals between a minimum VB interval and a maximum VB interval;

determining whether a graphics processing unit (GPU) will complete rendering a full or partial frame update a selected time before the second one of the plurality of VB intervals ends;

scheduling sending the full or partial frame update to the panel during a third one, following the second one, of the plurality of VB intervals based on a determination that the GPU will complete rendering the full or partial frame update the selected time before the second one of the plurality of VB intervals ends;

identify a fourth one of the plurality of VB intervals where a frame is not scheduled to be transmitted to the panel; and power down the display interconnect during the fourth one of the plurality of VB intervals.

15. The at least one non-transitory machine-readable storage medium of claim 14, comprising instructions that further cause the processor to:

cause he GPU to enter a lower power state upon completion of rendering the full or partial frame update based on a determination that the GPU will complete rendering the full or partial frame update the selected time before the second one of the plurality of VB intervals ends.

16. The at least one non-transitory machine-readable storage medium of claim 14, comprising instructions that further cause the processor to:

determine whether the display interconnect is shut down; and power up the display interconnect and synchronizing the transmitter with the panel based on a determination that the display interconnect is shut down.

17. The at least one non-transitory machine-readable storage medium of claim 14, comprising instructions that further cause the processor to increase the VB interval a threshold amount up to the maximum VB interval allowed by the panel to dynamically modify the second one of the plurality of VB intervals between the minimum VB interval and the maximum VB interval.

18. The at least one non-transitory machine-readable storage medium of claim 14, comprising instructions that further cause the transmitter to send the frame in accordance with the Embedded Display Port (eDP) Standard v 1.4, published in February 2015 and promulgated by the Video Electronics Standards Association (VESA).

19. The at least one non-transitory machine-readable storage medium of claim 14, the display interconnect comprising a display port interconnect or an embedded display port interconnect.

* * * * *